US008566083B2

(12) United States Patent
Jax et al.

(10) Patent No.: US 8,566,083 B2
(45) Date of Patent: Oct. 22, 2013

(54) METHOD FOR DECODING AN AUDIO SIGNAL THAT HAS A BASE LAYER AND AN ENHANCEMENT LAYER

(75) Inventors: Peter Jax, Hannover (DE); Sven Kordon, Wunstorf (DE)

(73) Assignee: Thomson Licensing (FR)

( * ) Notice: Subject to any disclaimer, the term of this patent is extended or adjusted under 35 U.S.C. 154(b) by 516 days.

(21) Appl. No.: 12/807,383

(22) Filed: Sep. 3, 2010

(65) Prior Publication Data

US 2011/0060596 A1 Mar. 10, 2011

(30) Foreign Application Priority Data

Sep. 4, 2009 (EP) ..... 09305810

(51) Int. Cl.
*G10L 21/00* (2013.01)
*G10L 21/02* (2013.01)

(52) U.S. Cl.
USPC ..... 704/205; 704/211; 704/228

(58) Field of Classification Search
USPC ..... 704/205, 211, 228
See application file for complete search history.

(56) References Cited

U.S. PATENT DOCUMENTS

| | | | | |
|---|---|---|---|---|
| 6,208,959 | B1 * | 3/2001 | Jonsson et al. | 704/209 |
| 7,240,000 | B2 * | 7/2007 | Harada | 704/212 |
| 7,343,287 | B2 | 3/2008 | Geiger et al. | |
| 7,835,904 | B2 * | 11/2010 | Li et al. | 704/200.1 |
| 7,945,448 | B2 * | 5/2011 | Wang et al. | 704/500 |
| 7,949,518 | B2 | 5/2011 | Oshikiri | |
| 8,386,271 | B2 * | 2/2013 | Koishida et al. | 704/503 |
| 2003/0135376 | A1 | 7/2003 | Harada | |
| 2003/0152165 | A1 * | 8/2003 | Kondo et al. | 375/316 |
| 2004/0174911 | A1 * | 9/2004 | Kim et al. | 370/538 |
| 2009/0248424 | A1 * | 10/2009 | Koishida et al. | 704/503 |

FOREIGN PATENT DOCUMENTS

| | | |
|---|---|---|
| CN | 1675683 | 9/2005 |
| CN | 1947173 | 4/2007 |
| EP | 1903559 | 3/2008 |

OTHER PUBLICATIONS

Geiger et al., "IntMDCT—A Link Between Perceptual and Lossless Audio Coding", 2002 IEEE International Conference on Acoustics, Speech, and Signal Processing Proceedings, (ICASSP), Orlando, Florida, vol. 2, May 13-17, 2002, pp. II-1813.
Geiger et al., "ISO/IEC MPEG-4 High-Definition Scalable Advanced Audio Coding", AES, vol. 55, No. 1/2. Jan. 2007, pp. 27-43.
European Search Report Dated: Mar. 8, 2010.

* cited by examiner

*Primary Examiner* — Eric Yen
(74) *Attorney, Agent, or Firm* — Jack Schwartz and Associates, PLLC

(57) ABSTRACT

An audio signal may have a BL and an EL, wherein the EL represents additional information for enhancing the quality of the BL audio content. Decoding of such dual-layer signals usually comprises partial decoding of the BL data, wherein frequency bins of the BL are restored, mapping the restored frequency bins to the MDCT domain, adding them to the decoded EL and performing inverse Integer MDCT. A low-complexity method for decoding comprises reverse mapping of the decoded EL data, adding the reverse mapped EL data to the partially decoded BL data and filtering the sum, using the inverse BL filter bank.

19 Claims, 3 Drawing Sheets a)

b)

METHOD FOR DECODING AN AUDIO SIGNAL THAT HAS A BASE LAYER AND AN ENHANCEMENT LAYER

This application claims the benefit, under 35 U.S.C. §119 of EP Patent Application No. 09305810.5, filed Sep. 4, 2009.

FIELD OF THE INVENTION

This invention relates to a method for decoding an audio signal that has a base layer and an enhancement layer.

BACKGROUND OF THE INVENTION

An audio signal may have a base layer and an enhancement layer, collectively referred to as dual-layer, wherein the base layer represents a limited-quality version of encoded audio content and the enhancement layer represents encoded additional information for enhancing the quality of the audio content. For example, a bit stream may be composed of a low-bit-rate layer, such as e.g. an mp3 (MPEG-1 Layer III) bit stream, plus an additional layer that extends the base quality to an enhanced quality. In principle also more than one additional layer may be used, from which the highest may even enable bit-exact representation of the original PCM (pulse-code modulated) samples.

Encoding of such dual-layer signals is usually performed by encoding a base layer, thereby omitting certain information on the input signal, and then at least partly reconstructing the encoded base layer to get a prediction signal. Further, a difference signal between the prediction signal and the full-quality input signal is determined and encoded. The encoded difference signal then serves as enhancement layer.

FIG. 1 shows the encoder of an embedded lossless audio codec. In the upper signal path, the input signal is used to encode the base layer bit stream. The base layer encoder can e.g. be compliant to mp3. The base-layer codec applies a filter bank 11 for time-frequency decomposition that is unequal to the MDCT filter bank 13 applied in the extension layer signal path. In the exemplary case of mp3, the base layer filter bank 11 is a hybrid filter bank, composed of a 32-band polyphase filter bank, followed by independent MDCT analysis blocks in each sub-band. In the second signal path, the input signal is fed into an Integer MDCT block 13 which implements a perfectly reversible MDCT decomposition of the signal. The integer-valued MDCT frequency bins are the basis for lossless encoding of the extension layer information.

Since the hybrid base layer filter bank 11 is different from the Integer MDCT filter bank 13 of the enhancement layer, a mapping operation is required for obtaining the prediction signal. For this purpose, the base layer frequency bins (in the domain of the hybrid filter bank 11) are restored 16 by partial decoding, and then mapped to the MDCT domain. The mapping 17 can be performed in an efficient way, as e.g. described in EP 2 064 700 A1[1]. The mapped base layer information is then subtracted 14 from the integer-valued MDCT coefficients. The residual coefficients s14 are fed into an entropy encoder 15 in order to minimize the bit rate that is required to transmit the lossless extension layer.

[1] PD060080

Decoding of such dual-layer signals usually uses a procedure as is shown in FIG. 2. In the upper signal path, the base layer information is partially decoded 21 in order to recover the frequency bin information. Synthesis filtering to the time domain is not performed at this point, since this would only be required for decoding a base layer signal. Then precisely the same operations are conducted as in the encoder, that is, the frequency bins of the base layer information are restored (decoded) 22, and a mapping 23 of the restored frequency bins to the MDCT domain is performed. In parallel, the lower signal path decodes the extension bit stream. The output s24 of the entropy decoder 24 is identical to the error residual s14 of the base layer in the MDCT domain, as computed by the encoder's subtraction block 14. The error residual s24 is added 25 to the coefficients s23 mapped from the base layer information, and the sum is fed into an inverse Integer MDCT block 26. The output signal of the inverse Integer MDCT is perfectly identical (bit-exact) to the original input signal that was fed into the encoder.

A similar example is given in FIG. 4 of "IntMDCT—A Link Between Perceptual and Lossless Audio Coding", 2002, IEEE by R. Geiger, J. Herre, J. Koller and K.-H. Brandenburg.

Audio decoders are often implemented within small portable and battery driven devices. It is therefore generally desirable to perform the decoding of encoded audio signals in a manner that saves power. In decoder implementations that are based on processors, this is equivalent with reducing the number of processing cycles that the processor has to execute.

SUMMARY OF THE INVENTION

The present invention provides an efficient solution for reducing the power that is required for decoding dual-layer audio signals.

According to one general aspect of the invention, a method for decoding an audio signal that has a base layer signal portion and an enhancement layer signal portion, wherein the enhancement layer signal portion was predicted from the base layer signal portion using filter bank domain mapping, comprises steps of partially decoding the encoded base layer portion, reversely mapping the enhancement layer portion according to a simplified reversal of said filter bank domain mapping, adding the reversely mapped enhancement layer portion to the partially decoded base layer portion, and synthesis filtering the output signal of said adding, using an inverse base layer filter bank.

According to another general aspect of the invention, a decoder for decoding an audio signal that has a base layer signal portion and an enhancement layer signal portion, wherein the enhancement layer signal portion was predicted from the base layer signal portion using filter bank domain mapping, comprises a partial decoder for partially decoding the encoded base layer portion, a first mapper for reversely mapping the enhancement layer portion according to a simplified reversal of said filter bank domain mapping, a first adder for adding the reversely mapped enhancement layer portion to the partially decoded base layer portion, and a first synthesis filter for synthesis filtering the output signal of said adding, wherein the first synthesis filter operates as inverse base layer filter bank.

According to one aspect of the invention, a method for decoding an audio signal that has a base layer signal portion and an enhancement layer signal portion, wherein the base layer signal portion and the enhancement layer signal portion are obtained from different filter types and are in different filter bank domains, and wherein the enhancement layer signal portion was predicted from the base layer signal portion using filter bank domain mapping and then entropy encoded, comprises steps of partially decoding the encoded base layer portion, entropy decoding the enhancement layer portion, reversely mapping the entropy decoded enhancement layer portion according to a simplified reversal of said filter bank domain mapping, adding the reversely mapped enhancement layer portion to the partially decoded base layer portion, and synthesis filtering the output signal of said adding, using an inverse base layer filter bank.

According to another aspect of the invention, a decoder for decoding an audio signal that has a base layer portion and an enhancement layer portion, wherein the base layer portion and the enhancement layer portion are in different filter bank domains, and wherein the enhancement layer portion was predicted from the base layer portion using filter bank domain mapping and then entropy encoded, comprises a partial decoder for partially decoding the base layer portion, an entropy decoder for entropy decoding the enhancement layer portion, a first mapping element for reversely mapping the entropy decoded enhancement layer signal according to simplified reversal of said filter bank domain mapping, a first adder for adding the reversely mapped enhancement layer to the partially decoded base layer, and a first synthesis filter for filtering the output signal of said adding, wherein the first synthesis filter operates as inverse base layer filter bank.

In one embodiment, the base layer portion comprises frequency bins, and the partial decoding of the base layer signal comprises recovering said frequency bins.

It is to be noted that simplified reversal of a filter bank domain mapping means a reverse operation that is executed with lower precision than the original filter bank domain mapping. The lower precision may refer to numeric rounding as well as to a simplification of filtering functions for a more efficient implementation.

One advantage of the invention is that it is applicable to existing coding formats, and requires no particular format. Further advantageous embodiments of the invention are disclosed in the dependent claims, the following description and the figures.

BRIEF DESCRIPTION OF THE DRAWINGS

Exemplary embodiments of the invention are described with reference to the accompanying drawings, which show in FIG. 1 an encoder of an embedded lossless audio codec.

EXEMPLARY EMBODIMENTS OF THE INVENTION

In the following, exemplary embodiments of the invention are described that refer to MPEG-1 Layer III (mp3). However, the invention can also be used in embodiments for similar audio encoding formats that rely on filter banks, and particularly if filter bank domain mapping is required.

Figure 3:
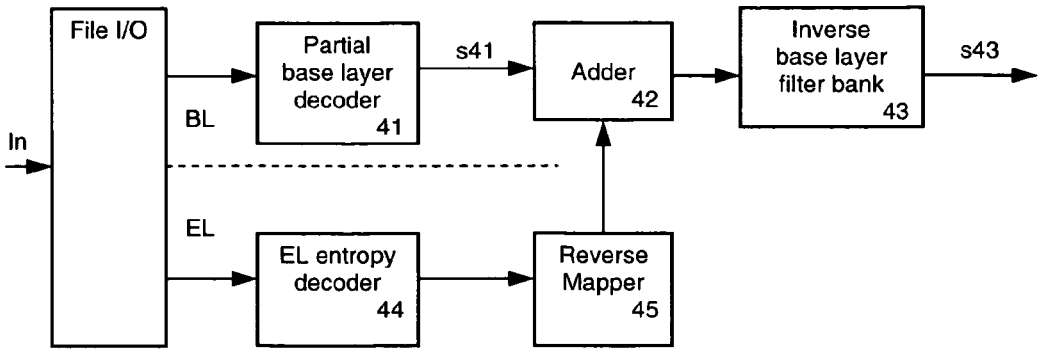
FIG. 3 the structure of an enhanced low-complexity decoder.

A block diagram of the decoding approach according to one aspect of the invention is depicted in FIG. 3. An input signal In may be obtained from any kind of data source, e.g. from a file read from any storage element, or from a receiver for wireless or wired data broadcast or unicast. The input signal In is pre-processed in order to separate base layer portions from enhancement layer portions, e.g. by file I/O processing. The base layer signal is then input to a partial base layer decoder 41, which generates a base layer signal s41 in the base layer filter bank domain. The partial base layer decoder 41 performs only partial decoding, i.e. no transformation back to the time domain. While in a conventional base layer decoder this base layer filter bank domain signal s41 would directly be input to an inverse base layer filter bank 43 in order to obtain time-domain signals, the enhanced decoder comprises an adder 42 for adding enhancement data, before the sum of base layer and enhancement layer signal is input to said inverse base layer filter bank 43. Advantageously, the filter bank 43 can be the same as for conventional mp3 base layer decoding. The enhancement data are generated from the enhancement layer by a reverse mapper 45. The reverse mapper 45 maps data from the MDCT domain of the enhancement layer to the filter bank domain of the base layer. Since the input data are often entropy encoded, the enhancement layer data are in one embodiment of the invention obtained from an entropy decoder 44. If the input data are encoded differently or not at all, the entropy decoder 44 can be replaced by a corresponding decoder, or it can be skipped respectively.

Compared to a conventional bit-exact full lossless decoder, as described above with respect to FIG. 2, the signal flow has been modified in parts of the low-complexity decoder: instead of mapping the frequency bins from the filter-bank domain of the base layer codec to the MDCT domain of the enhancement layer codec, the mapping is done in reverse direction: the enhanced decoder uses reverse mapping 45 from the MDCT domain to the domain of the mp3 base layer codec. Accordingly, the output of the mapping (i.e. the mapped error residual) is added 42 directly to the decoded frequency bins of the base layer. Therefore, it is possible to obtain enhanced time-domain signals by utilizing the synthesis filter-bank (FB) 43 of the base layer codec.

Figure 4:
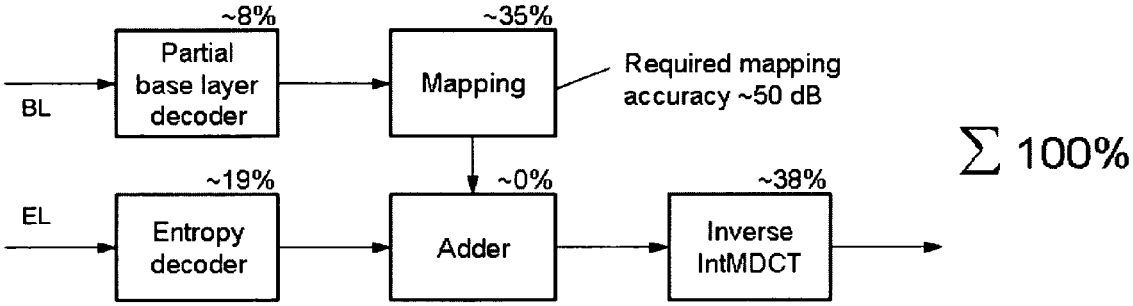
FIG. 4 relative computational complexities in a bit-exact decoder.

One advantage of the enhanced decoder is that it uses considerably less power for decoding, compared to a bit-exact decoder, while generating an audio output signal of comparable quality. FIG. 4 shows relative computational complexities of the blocks of a bit-exact conventional decoder. Computational complexity is generally equivalent to power consumption, since it corresponds to a number of processing cycles of one or more processing elements, e.g. processors, which execute the computations. Measurements and calculations of the inventors have revealed the following: The partial base layer decoder consumes about 8% and the enhancement layer entropy decoder consumes about 19% of the conventional decoder's total power consumption. The mapping block and the inverse Integer MDCT block require relatively high shares of 35% and 38% respectively of the total power consumption. The adder has a relatively simple structure and requires virtually no power, compared with the other blocks. Thus, the total power consumption of partial base layer decoder, enhancement layer entropy decoder, mapping block and inverse Integer MDCT block add up to 100%.

Figure 5:
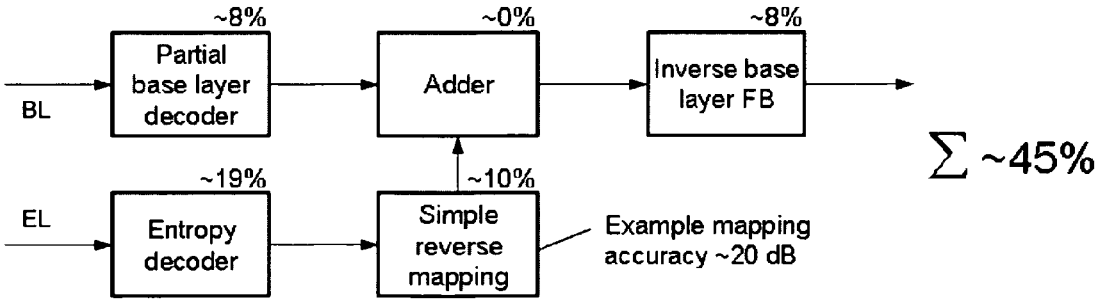
FIG. 5 relative computational complexities in an enhanced low-complexity decoder.

FIG. 5 shows computational complexities of the blocks of an enhanced dual-layer decoder, relative to the conventional decoder. As a comparison shows, both implementations use the same partial base layer decoder and entropy decoders, which consume about 8% and 19% of the total power consumption. However, major reductions in power consumption are obtained by using a reverse mapper 45 instead of the conventional mapper, and by using the inverse base layer filter bank 43 instead of the inverse Integer MDCT filter bank. The reverse mapper 45 consumes only about 10% of the total power consumption of a conventional decoder, and replaces the mapping block which consumed 35% of the total power. Thus, savings of (35%−10%=) 25% are obtained by this measure. Further, the inverse base layer filter bank 43 requires only about 8% of the conventional total power consumption, and replaces the inverse Integer MDCT block which used 38%. This measure leads to savings of (38%−8%=) 30% of the total power consumption. The adder is slightly different, since it adds signal portions in the domain of the base layer filter bank now instead of MDCT domain signal portions. The adder may even be less complex, since it needs not be compliant with a specific data format or arithmetic behaviour. However, the adder still requires practically no power. Thus, the total power consumption of the enhanced decoder was reduced to by 55% down to 45% of the power consumption of the conventional decoder. This makes the enhanced decoder according to the invention preferable for low-power applications, e.g. in battery operated devices.

Figure 1:
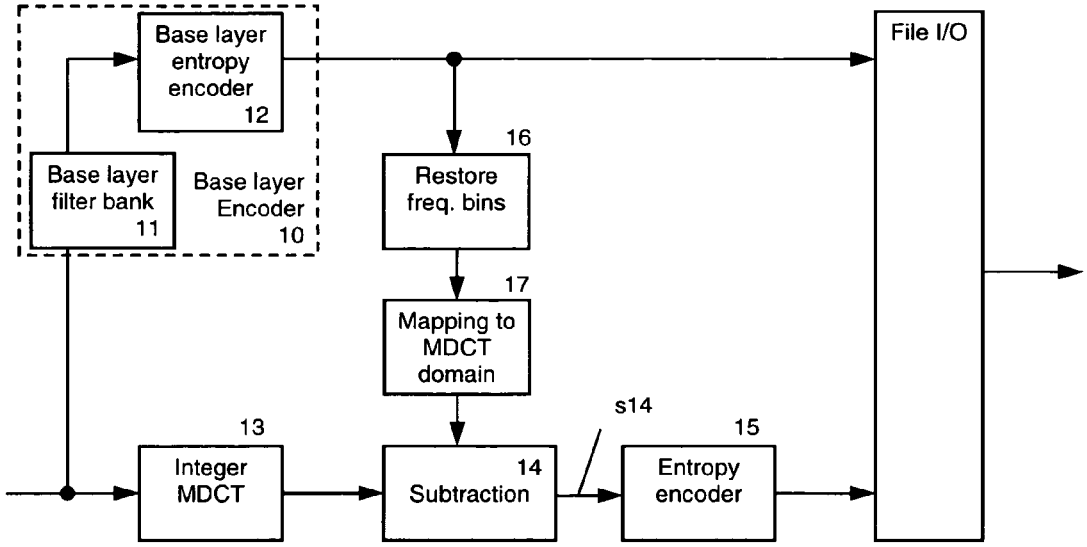
Figure 2:
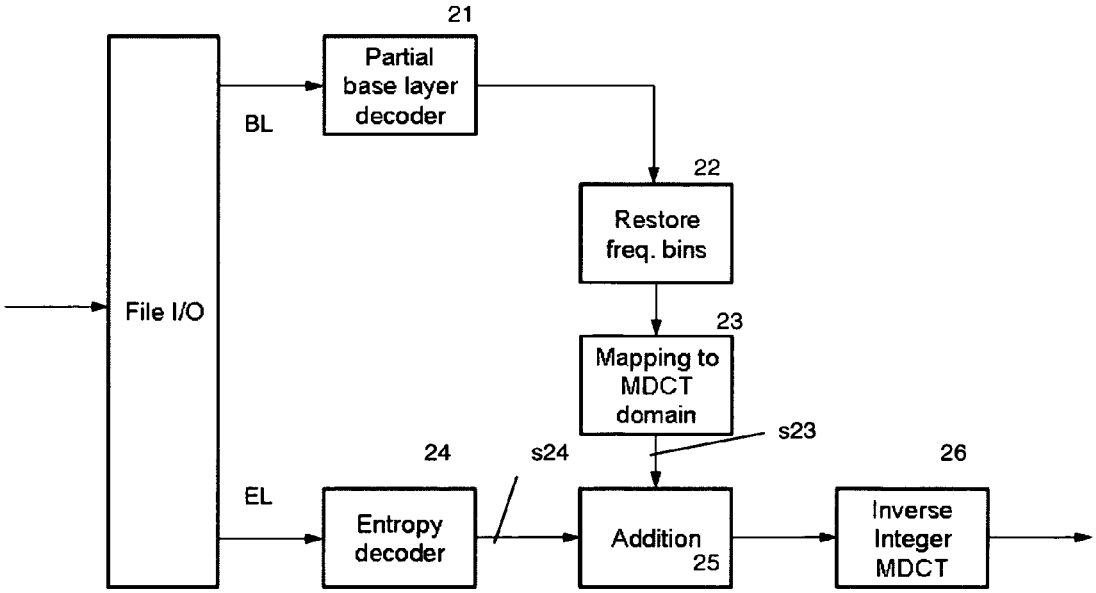
FIG. 2 a bit-exact audio decoder for encoded dual-layer audio data.

In terms of computational complexity, the new approach has two advantages:

First, the reverse mapping in the reverse mapper 45 can have a much lower signal-to-distortion ratio (SDR) than the forward mapping shown in FIG. 2. A reason for the much lower precision requirement is that the input to the mapping is the error residual. Any distortion produced by the reverse mapping procedure adds up directly to the low-power residual signal. Thus, although the absolute distortion of the reverse mapping may be in the same order of magnitude as for the forward mapping, the SDR requirement can be as much lower as the reduced power of the input signal. In practice, it is sufficient for the reverse mapper 45 to have a mapping accuracy of about 20 dB, instead of 50 dB as required for the forward mapping. Because of the lower SDR requirements, the computational complexity of the reverse mapping 45 is much lower than that of the forward mapping.

Second, in addition, the less complex inverse filter bank 43 procedure of the base layer codec can be used. In the above example, the synthesis filter bank of the mp3 codec can be used, which requires only about 8% of the complexity of a full lossless decoder, instead of the about 38% for the inverse Integer MDCT. The inverse base layer filter bank 43 performs considerably less operations than the conventional inverse Integer MDCT.

As mentioned above, simplified reversal of a filter bank domain mapping, as executed in the reverse mapper 45, means a reverse operation that is executed with lower precision than the original filter bank domain mapping. The lower precision may refer to numeric rounding as well as to a simplification of filtering functions for a more efficient implementation. Examples are the skipping of one or more correction steps, or the usage of shorter phase correction filters. Further examples are given in EP 2 064 700 A1.

In summary, the enhanced signal flow leads to a new near-lossless decoding structure, which is easier to implement and is suitable for obtaining an audio quality that is considerably better than that of a plain base-layer decoder. This is achieved by utilizing information from the extension layer in the reverse mapping of the error residual signal.

Due to the different processing, the output signal of an enhanced low-complexity decoder is not bit-exact identical to the original input signal. However, the low-complexity enhanced decoder according to the invention provides in its output signal all frequency portions of the original input signal. Advantageously, there is no audible difference between the signals. Thus, from a quality point of view, the low-complexity decoder is fully comparable to a bit-exact decoder.

A more detailed analysis of the distortion reveals the following. The reverse mapping actually transforms three signal components into the base layer filter bank domain, namely the quantization error of the mp3 base layer, quantization errors of the Integer MDCT and accumulated quantization errors, or distortions respectively, of the forward and backward mapping. For these error types, the following holds:

The quantization error of the mp3 base layer when taken alone supplements perfectly the decoded frequency components of the mp3 layer. I.e., when considering only this error type, the low-complexity decoding according to the invention results in a perfect reconstruction of the input signal, as far as the frequency spectrum is concerned.

The quantization error of the Integer MDCT results inevitably from the Integer MDCT analysis filter. It is spectrally flat and uncorrelated. In the decoding according to the invention this error leads to additive, white Gaussian noise with a variance of about 2.6/12 (LSB^2) in the resulting time domain signal, which is substantially stationary. The effect of this error type is comparable to a reduction in PCM word width e.g. from 16 bit/sample to 15 bit/sample. With typical, well-leveled audio content this error type can be neglected, since it is not audible.

The mapping error is signal dependent and contains linear and non-linear distortions with a signal-to-noise-ratio (SNR) of about 50-60 dB. That is, the error power varies with the signal power, having a constant distance of about 50-60 dB.

Figure 7:
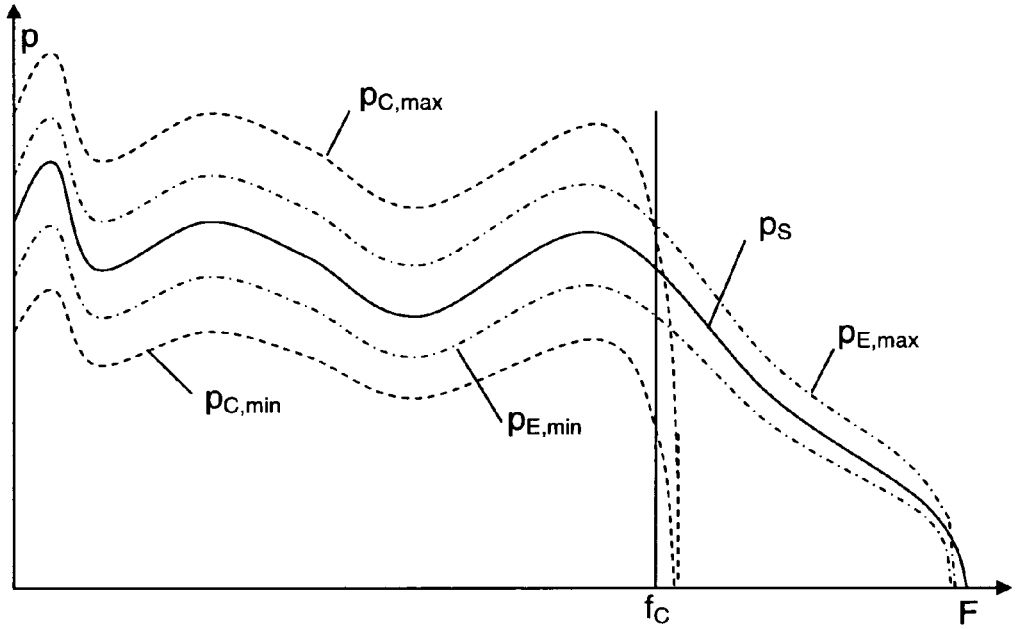
FIG. 7 an exemplary power spectrum of a source audio signal, a conventionally decoded audio signal and an enhanced decoded audio signal, and corresponding error spectra.
Figure 7:
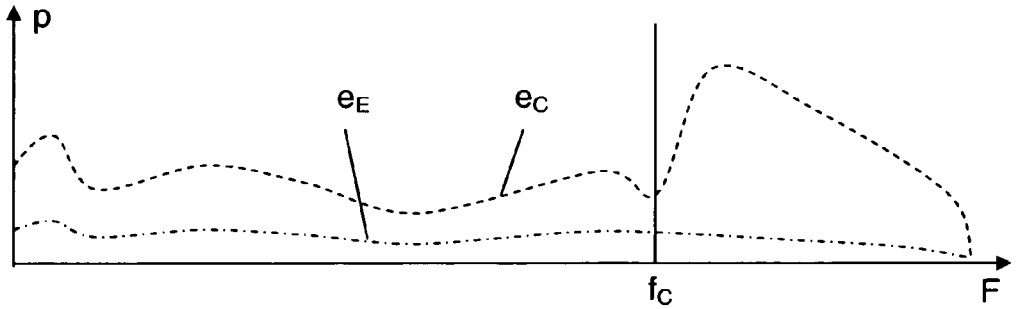

In summary, the output signal of the low-complexity decoder according to the invention is comparable to that of a bit-exact enhancement layer decoder, and has much better audio quality than that of a base layer decoder, while the required computational effort is much lower than that of a conventional bit-exact enhancement layer decoder. E.g., the low-complexity decoder provides a SNR of 50-60 dB, compared to 20 dB for conventional mp3 with a typical bit-rate of 128 kbit/s. Subjectively, the degree of quality improvement depends on the mp3 bit-rate of the base layer. Particularly for common low and medium bit-rates the improvement is high. FIG. 7 shows a power spectrum $p_S$ of an exemplary source audio signal, a conventionally decoded base-layer audio signal $p_C$ and an enhanced decoded audio signal $p_E$, and corresponding variance (error) spectra $e_C$, $e_E$. A bit-exact decoder provides a full-quality audio signal that is identical to the input signal $p_S$. In the conventionally decoded base-layer audio signal $p_C$, such as an output signal of a normal mp3 player, higher frequency portions are cut off. Typically the spectral portion beyond a cut-off frequency $f_C$ has only low impact on audio quality, and is therefore removed in the (base-layer) encoder. Thus, the error $e_C$ of the conventional mp3 signal is particularly high for the higher frequencies. The actual cut-off frequency $f_C$ may vary slightly, depending on the current signal energy. However, at least for certain audio scenes these frequency portions are at least partly perceptible for many persons, and their deletion may considerably decrease audio quality.

On the contrary, the output signal $p_E$ of a low-complexity dual-layer decoder according to the invention has less deviation from the input signal $p_S$ and includes all frequency components of the input signal $p_S$. Its error signal $e_E$ has therefore much lower power and is much more constant over the whole frequency range. It is to be noted that FIG. 7 shows exemplary short-time spectra and uses a logarithmic scale for the vertical (power) axes, and that error power generally depends on signal power of the input and output signals, and further that the actual power of the decoded audio signals $p_C$, $p_E$ varies between minimum and maximum values $p_{C,min}$-$p_{C,max}$ and $p_{E,min}$-$p_{E,max}$ respectively, but is on average identical with the original signal $p_S$ at least well below the cut-off frequency $f_C$. Though FIG. 7 is scaled in an exaggerated manner for clarifying the differences, the $p_{E,min}$-$p_{E,max}$ range is much closer to the original $p_S$ than the $p_{C,min}$-$p_{C,max}$ range, which means a better audio quality of $p_E$. The new decoding approach is particularly beneficial for devices with low computational power or with limited power supply, e.g. for battery-powered devices. To make a usage of the low-complexity decoding feature more comprehensible and user-friendly, automatic switching between full lossless (bit-exact) decoding and low-complexity, near-lossless decoding can be applied. Examples include

- auto-switch decoding mode depending on the power source: When a device is battery-powered, near-lossless mode is used. When the device is connected to a more reliable power source, e.g. mains voltage, bit-exact lossless mode is used. The switching can be done automatically, in response to a power source detector.
- auto-switch decoding mode depending on gross processor load: When high load through other executables is imposed on the processor, near-lossless mode is used. Otherwise, when the load of the processor is lower, bit-exact lossless mode is used. The switching can be done automatically, in response to a processing load detector.
- auto-switch decoding mode depending on the required signal output: When lower-quality output, e.g. analogue line-level output, is required, near-lossless mode is used. When higher quality output, e.g. digital SPDIF output, is required, bit-exact lossless mode is used. The switching can be done automatically, in response to an output type detector.

The above examples may employ thresholds (voltage threshold, processing load threshold) and corresponding detectors. For example, a condition for enabling power saving mode may be that the processing load of at least one processing element performing one or more steps of the decoding method is beyond a threshold. Various combinations of two or more different conditions are possible, e.g. high processing load and low supply power.

Figure 6:
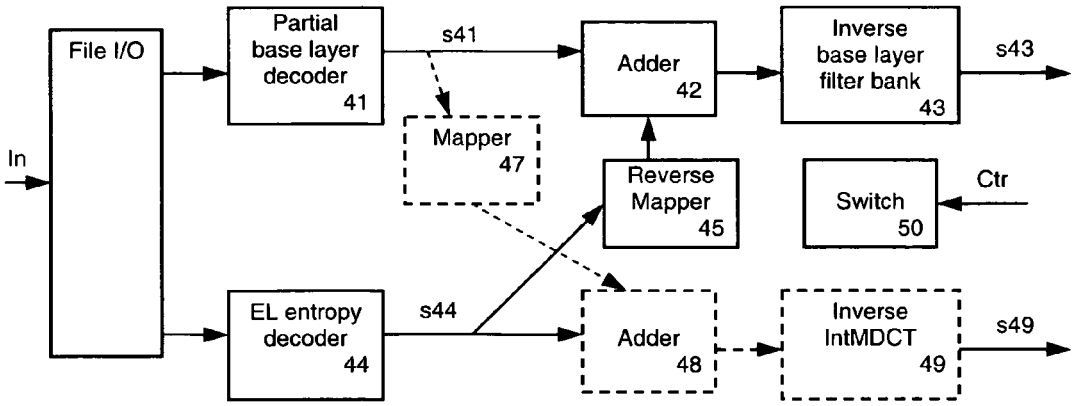
FIG. 6 the structure of a flexible decoder comprising a bit-exact decoding portion and a low-complexity decoding portion.

FIG. 6 shows an exemplary decoder that uses an auto-switch decoding mode depending on current operating conditions. A mechanical or electronic power source detector, or an electronic voltage threshold detector, processing load threshold detector or the like, provides a control signal Ctr that is used for controlling a switch 50. The switch 50 enables either a power saving mode using the near-lossless low-complexity decoding mode according to the invention, as shown in FIG. 3, or enables a full-power mode using the conventional bit-exact lossless decoding mode as shown in FIG. 2.

In the power saving mode, the switch 50 enables the reverse mapper 45, a first adder 42 and the inverse base layer filter bank 43. Further, in the power saving mode the switch 50 disables a mapper 47, a second adder 48 and an inverse Integer MDCT 49. On the contrary, in the full-power mode the switch 50 enables the mapper 47, the second adder 48 and the inverse Integer MDCT 49, and disables the reverse mapper 45, the first adder 42 and the inverse base layer filter bank 43. The partial base layer decoder 41 and the enhancement layer entropy decoder 44 are used in both modes. The mapper 47 may perform restoring frequency bins and actual mapping to the MDCT domain, as shown in FIG. 2. Disabling or enabling of the first and/or second adder 42, 48 may be unnecessary, since they require practically no power.

In principle also more than one enhancement layer may be used, so that a hierarchical multi-layer structure exists. In that case, the invention may also be applied to any two successive layers within the hierarchy, where one of the two layers serves for predicting the other and wherein filter bank domain mapping is used for the prediction.

It should be noted that although shown simply as adders 42, 48, more sophisticated superposition elements may be used other than adders, as would be apparent to those of ordinary skill in the art, all of which are contemplated within the spirit and scope of the invention.

While there has been shown, described, and pointed out fundamental novel features of the present invention as applied to preferred embodiments thereof, it will be understood that various omissions and substitutions and changes in the apparatus and method described, in the form and details of the devices disclosed, and in their operation, may be made by those skilled in the art without departing from the spirit of the present invention. Although the present invention has been disclosed with regard to mp3, one skilled in the art would recognize that the method and devices described herein may be applied to various kinds of dual-layer audio decoding. It is expressly intended that all combinations of those elements that perform substantially the same function in substantially the same way to achieve the same results are within the scope of the invention. Substitutions of elements from one described embodiment to another are also fully intended and contemplated.

It will be understood that the present invention has been described purely by way of example, and modifications of detail can be made without departing from the scope of the invention. Each feature disclosed in the description and (where appropriate) the claims and drawings may be provided independently or in any appropriate combination. Features may, where appropriate be implemented in hardware, software, or a combination of the two. Where applicable, connections may be implemented as wireless or wired, not necessarily direct or dedicated, connections. Like reference numerals designate identical or corresponding elements throughout. Reference numerals appearing in the claims are by way of illustration only and shall have no limiting effect on the scope of the claims.

What is claimed is:

1. A method for decoding an audio signal that has a base layer portion and an enhancement layer portion, wherein the base layer portion and the enhancement layer portion are in different filter bank domains, and wherein the enhancement layer portion was predicted from the base layer portion using filter bank domain mapping and then entropy encoded, comprising the steps of partially decoding, via a processor, an encoded base layer portion; entropy decoding the enhancement layer portion; reversely mapping, via the processor, the entropy decoded enhancement layer portion according to a simplified reversal of said filter bank domain mapping; adding, via the processor, the reversely mapped enhancement layer portion to the partially decoded base layer portion; and synthesis filtering, via the processor, the output signal of said adding, using an inverse base layer filter bank.

2. The method according to claim 1, wherein the base layer portion comprises frequency bins, and wherein the partial decoding of the base layer signal comprises recovering said frequency bins.

3. The method according to claim 1, wherein the partial decoding of the base layer signal does not perform a transformation to the time domain.

4. The method according to claim 1, wherein, from the step of synthesis filtering, a signal is obtained that has the same frequency spectrum as the audio signal, but is not a bit-exact copy of the audio signal.

5. The method according to claim 1, wherein a simplified decoding mode includes the steps of reversely mapping the entropy decoded enhancement layer portion, adding the reversely mapped enhancement layer to the partially decoded base layer portion and synthesis filtering, and further comprising steps of providing a lossless decoding mode, wherein the partially decoded base layer signal is mapped from the base layer filter bank domain to the MDCT domain, the resulting MDCT domain signal is added to the entropy decoded enhancement layer signal, wherein full spectrum frequency bins are obtained, and inverse Integer MDCT is performed on the full spectrum frequency bins, wherein a lossless decoded signal is obtained; and switching between the simplified decoding mode and the lossless decoding mode.

6. The method according to claim 5, further comprising steps of detecting a condition for enabling or disabling a power saving mode; and upon said detecting, automatically switching to the simplified decoding mode if a condition for enabling power saving mode was detected, or switching to lossless decoding mode if a condition for disabling power saving mode was detected.

7. The method according to claim 6, wherein conditions for enabling power saving mode comprise power supply from a battery or low power availability.

8. The method according to claim 6, wherein conditions for enabling power saving mode comprise that a processing load of at least one processing element performing one or more steps of the method is beyond a threshold.

9. The method according to claim 5, wherein the lossless decoded signal of the lossless decoding mode is a bit-exact representation of the audio signal.

10. The method according to claim 1, wherein the simplified reversal is one of numeric rounding, or a simplification of filtering functions.

11. The method according to claim 1, wherein the base layer signal is an MP3 formatted audio signal.

12. A device for decoding an audio signal that has a base layer portion and an enhancement layer portion, wherein the base layer portion and the enhancement layer portion are in different filter bank domains, and wherein the enhancement layer portion was predicted from the base layer portion using filter bank domain mapping and then entropy encoded, comprising a partial decoder configured to partially decode the base layer portion; an entropy decoder configured to entropy decode the enhancement layer portion; a first mapping element configured to reversely map the entropy decoded enhancement layer signal according to simplified reversal of said filter bank domain mapping; a first adder configured to add the reversely mapped enhancement layer to the partially decoded base layer; and a first synthesis filter configured to filter the output signal of said adding, wherein the first synthesis filter operates as an inverse base layer filter bank.

13. The device according to claim 12, wherein the base layer portion comprises frequency bins and wherein the partial decoder recovers said frequency bins.

14. The device according to claim 12, wherein the partial decoder does not perform a transformation to the time domain.

15. The device according to claim 12, wherein, from the first synthesis filter, a signal is obtained that has the same frequency spectrum as the audio signal before encoding, but is not a bit-exact copy of said audio signal.

16. The device according to claim 12, further comprising a second, lossless decoder configured to provide a lossless decoding mode, wherein the second, lossless decoder comprises a second mapping element for mapping the partially decoded base layer signal from the filter bank domain to the MDCT domain, a second adding unit configured to add the resulting MDCT domain signal to the entropy decoded enhancement layer signal, wherein the original source frequency bins are obtained, and an inverse Integer MDCT filter bank configured to filter the original source frequency bins, wherein a lossless decoded audio signal is obtained; and a switching element configured to switch between the mapping element, the adder, the synthesis filter and the lossless decoder.

17. The device according to claim 16, further comprising a detector configured to detect a condition for enabling or disabling a power saving mode; and a switch configured to automatically switch to a simplified decoding mode upon said detecting a condition for enabling power saving mode, or switch to lossless decoding mode if a condition for disabling power saving mode was detected.

18. The device according to claim 12, wherein the base layer signal is an MP3 formatted audio signal.

19. The device according to claim 12, wherein the reduced precision refers to numeric rounding or to a simplification of filtering functions.

* * * * *